US005638751A

United States Patent [19]

Daetwyler et al.

[11] Patent Number: 5,638,751

[45] Date of Patent: Jun. 17, 1997

[54] INTEGRATED DOCTOR BLADE AND BACK-UP BLADE

[75] Inventors: Peter Daetwyler, Davidson; James P. Dolan, Huntersville, both of N.C.

[73] Assignee: Max Daetwyler Corporation, Huntersville, N.C.

[21] Appl. No.: 329,369

[22] Filed: Oct. 26, 1994

[51] Int. Cl.[6] ..... B41F 15/42; B41F 3/82

[52] U.S. Cl. ..... 101/169; 101/15; 118/261

[58] Field of Search ..... 101/170, 169, 101/157, 365; 15/256.5, 256.51; 118/261

[56] References Cited

U.S. PATENT DOCUMENTS

| | | | |
|---|---|---|---|
| 3,884,145 | 5/1975 | Datwyler | 101/169 |
| 4,184,429 | 1/1980 | Widmer | 101/169 |
| 4,586,212 | 5/1986 | Gasser | 15/256.51 |
| 4,895,071 | 1/1990 | Benton | 101/169 |
| 5,145,724 | 9/1992 | Yanai et al. | 15/256.51 |

FOREIGN PATENT DOCUMENTS

| | | | |
|---|---|---|---|
| 0061093 | 9/1982 | European Pat. Off. | 101/169 |
| 2939906 | 4/1981 | Germany | 101/169 |

*Primary Examiner*—Edgar S. Burr
*Assistant Examiner*—Anthony H. Nguyen
*Attorney, Agent, or Firm*—Caesar, Rivise, Bernstein, Cohen & Pokotilow, Ltd.

[57] ABSTRACT

A wiping blade, especially useful as a doctor blade for gravure printing and made from a single piece of unitary material, e.g., metal, is provided. The doctor blade has a top surface and a planar bottom surface spaced from the top surface. Front and rear longitudinal edges are spaced from and parallel to each other. The blade has a backup portion which has a first thickness and extends a first distance from the rear edge toward the front edge. The blade also has a doctor blade portion that extends a second distance from the backup portion toward the front edge and has a second thickness less than the first thickness. Furthermore, the doctor blade can include a blade tip portion that extends a third distance from the doctor blade portion to the front longitudinal edge and which has a third thickness less than the second thickness. The blade tip portion may also have an angled tip end at the front longitudinal edge angled upward from the planar bottom surface. A method of manufacturing the doctor blade is also provided.

9 Claims, 3 Drawing Sheets

INTEGRATED DOCTOR BLADE AND BACK-UP BLADE

FIELD OF THE INVENTION

This invention relates generally to the field of wiping blades, and in particular relates to an improved doctor blade for use in the wiping of cylinders used in various printing processes.

BACKGROUND OF THE INVENTION

Photogravure or gravure printing is a generally known printing technique whereby intaglio engravings of an image to be printed on a substrate (usually paper) are formed on the surface of a gravure cylinder. Intaglio engravings are those where the elements to be printed are formed below the surface of the gravure cylinder, typically by engraving into a metallic cylinder, thereby forming ink-retaining groves or cells in the cylinder. Used in conjunction with the etched or engraved gravure cylinder is the very important doctor blade which controls the amount of ink transferred from the printing surface of the cylinder to the paper or other substrate material.

Another method of printing is flexographic printing. This is also a technique where ink is carefully wiped from the surface of an engraved cylinder before the ink in the cells is transferred. Here, too, the doctor blade is very important.

A doctor blade is usually a long, thin resilient strip of metal that is mounted in the printing machine parallel to the axis of rotation of the cylinder, and the edge of the doctor blade comes into contact with the surface of the cylinder. When the machine is in operation, the doctor blade controls the amount of ink transferred to the substrate by wiping the excess ink from the surface of the cylinder, thereby leaving only the ink within the etching or engravings for transfer.

While proper etching or engraving of the cylinder is extremely important to the quality of the ultimate printed product, the significance of the doctor blade cannot be discredited. Indeed, even if the cylinder has been properly engraved, improper doctor blade design and usage will prevent the obtaining of a proper printed image.

Doctor blades for many years have been a two-part configuration of a backup blade and a doctor blade. Both the backup blade and doctor blade are held in a blade holder so that the doctor blade urges against the cylinder. Even though the doctor blade will wear as a result of the wiping action against the cylinder and must eventually be replaced, the backup blade is usually reusable. The backup blade adds support to the very thin doctor blade and securely holds the thin doctor blade in the blade holder. This multi-blade construction has many inherent drawbacks, not the least of which are accurately aligning and securing the blades in the blade holder, which requires manual skill and extended downtime for the press, and ink buildup between the blades which must be routinely eliminated.

A more recent development in doctor blade configurations involves the creation of doctor blades consisting of several layers of dissimilar material bonded or laminated together in some fashion to form a multi-layer doctor blade. As shown in U.S. Pat. No. 4,895,071 to Benton, the two-part doctor blade disclosed therein is comprised of a backup section and a doctoring section which are joined together. The doctoring section is that portion of the blade that actually contacts the gravure cylinder and is made from doctor blade steel. The usually wider backup portion; however, is made of less costly tin-free steel (TFS) or TFS coated with chromium for corrosion protection. Since the TFS is less expensive than the doctor blade steel, an economy in manufacture is perceived.

Although the manufacture and use of such multi-layer doctor blades is now known, there are significant disadvantages that need to be overcome. The most obvious drawback to the multi-layer construction is the need to accurately and effectively bond together two dissimilar materials to form the blade. The bonding technique is important just to achieve the bond, and the selection and sizing of the material is important from the standpoint of achieving proper rigidity of the composite blade. Even after the composite blade is formed difficulties persist. During use in the printing process, the various layers of the blade can separate, even minutely, and create spaces where ink and other contaminates from the cylinder can collect, dry and affect print quality. As mentioned above, bonding or laminating of the two dissimilar materials greatly affects the rigidity of the resultant blade. As a result, during the printing process, the pressure exerted by the doctor blade against the cylinder oftentimes must be constantly increased in order to insure proper wiping; however, the increased pressure causes increased friction against the cylinder and causes both the doctor blade and the cylinder to wear prematurely. As a concomitant effect, the fact that these multi-layer doctor blades are subject to the above disadvantages (which require frequent replacement of the blade), there is a resultant downtime of the press during the replacement period of either the cylinder or the blade which is a very significant economic consideration.

In light of these deficiencies of the prior doctor blade configurations, a more durable and cost efficient doctor blade is called for.

OBJECTS OF THE INVENTION

In view of the above background and the inherent disadvantages of the multi-layer doctor blades now available, it is a primary object of the present invention to eliminate the deficiencies of the multi-layer doctor blade by providing a doctor blade of unitary construction, i.e., incorporates both the backup blade section and the doctoring section of the blade into a single construction from a single blank of material.

It is a further object of the invention to provide a method of forming a unitary doctor blade from a single blank of high quality doctor blade material.

It is another object of the invention to provide a unitary doctor blade from a single blank of metal, such as high quality carbon steel.

It is yet another object of the invention to provide a unitary doctor blade from a single blank of plastics material.

It is an additional object of the invention to provide a doctor blade which is more rigid and uniformly resilient than previously obtainable with multi-layer blades, and therefore a doctor blade which can be used with less pressure against the engraved cylinder than is required with prior art technology.

It is a still further object of the invention to provide a doctor blade of unitary construction which results in longer use time and less downtime of the press due to wearing of the doctor blade and the cylinder.

It is also an object of the invention to provide a method of forming a doctor blade of unitary construction which can be easily formed to meet exact rigidity and flexibility requirements of different presses.

Finally, it is an object of the invention to provide a doctor blade which is adaptable for use in various wiping situations, including preparation of coatings from cylinders.

SUMMARY OF THE INVENTION

In an effort to overcome the drawbacks and deficiencies of the prior art doctor blade combinations for use in gravure printing and related wiping operations, the present invention is a doctor blade formed from a single piece of unitary material such as high quality carbon steel or high molecular weight plastics materials. The new doctor blade of this invention has a top surface and a planar bottom surface spaced from the top surface. Front and rear longitudinal edges of the blade are spaced from and parallel to each other. The blade, formed from the single piece of material, has a backup portion that extends a first distance from the rear edge toward the front edge and has a first thickness. In addition to the backup portion, there is a doctor blade portion adjacent the backup blade portion that has a second thickness less than the first thickness of the backup portion. The doctor blade portion extends a second distance from the backup portion toward the front edge. The edge of the doctor blade portion opposite the rear edge may be finished by machining a bevel into it at this point which extends upward and rearward from the bottom planar surface, or the blade top surface can be further ground to create a blade tip portion that extends a third distance from the doctor blade portion to the front longitudinal edge. This blade tip portion has a third thickness that is less than the second thickness of the doctor blade portion. The blade tip portion may also have an angled tip end at the front longitudinal edge angled upward and outward from the planar bottom surface.

In addition to the development of this unitary doctor blade configuration, the invention also includes a novel method for the preparation of the doctor blade. The method of the invention involves providing the rectangular blank of material which has the first top surface and the planar bottom surface spaced from the top surface, along with the front and rear longitudinal edges spaced from and parallel to each other. The first step of the procedure involves the removal of a portion of the first top surface of the blank a distance rearward from the front longitudinal edge toward and spaced from the rear longitudinal edge, whereby the backup portion of the blade is created adjacent the rear longitudinal edge and the doctor blade portion is created between the front longitudinal edge and the backup portion. The removal of a portion of the top surface of the blank produces a doctor blade portion that has a thickness less than the backup portion and a second top surface lower than the first top surface.

Creation of the backup blade portion and the doctor blade portion may be sufficient under some circumstances, but it is preferred in the invention to further remove a portion of the second top surface of the doctor blade portion in order to create the blade tip portion between the doctor blade portion and the front longitudinal edge. The blade tip portion has a thickness less than the thickness of the doctor blade portion, and a third top surface that is lower than the second top surface associated with the doctor blade portion.

In a further step, an angled tip can be formed at the front longitudinal edge of the blank at the front longitudinal edge of either the doctor blade portion or, if it is formed, the blade tip portion.

Each of the steps of removing material from the blank is achieved, preferably, by grinding away at the surface of the blank, and, preferably, the grinding of each surface is done in multiple steps so as not to adversely affect the physical properties or dimensions of the material of the blank.

BRIEF DESCRIPTION OF THE DRAWINGS

Other objects and many of the attendant advantages of the present invention will be readily appreciated as the same becomes better understood by reference to the following detailed description when considered in conjunction with the accompanying drawings, wherein.

DETAILED DESCRIPTION OF THE PREFERRED EMBODIMENT

Figure 1:
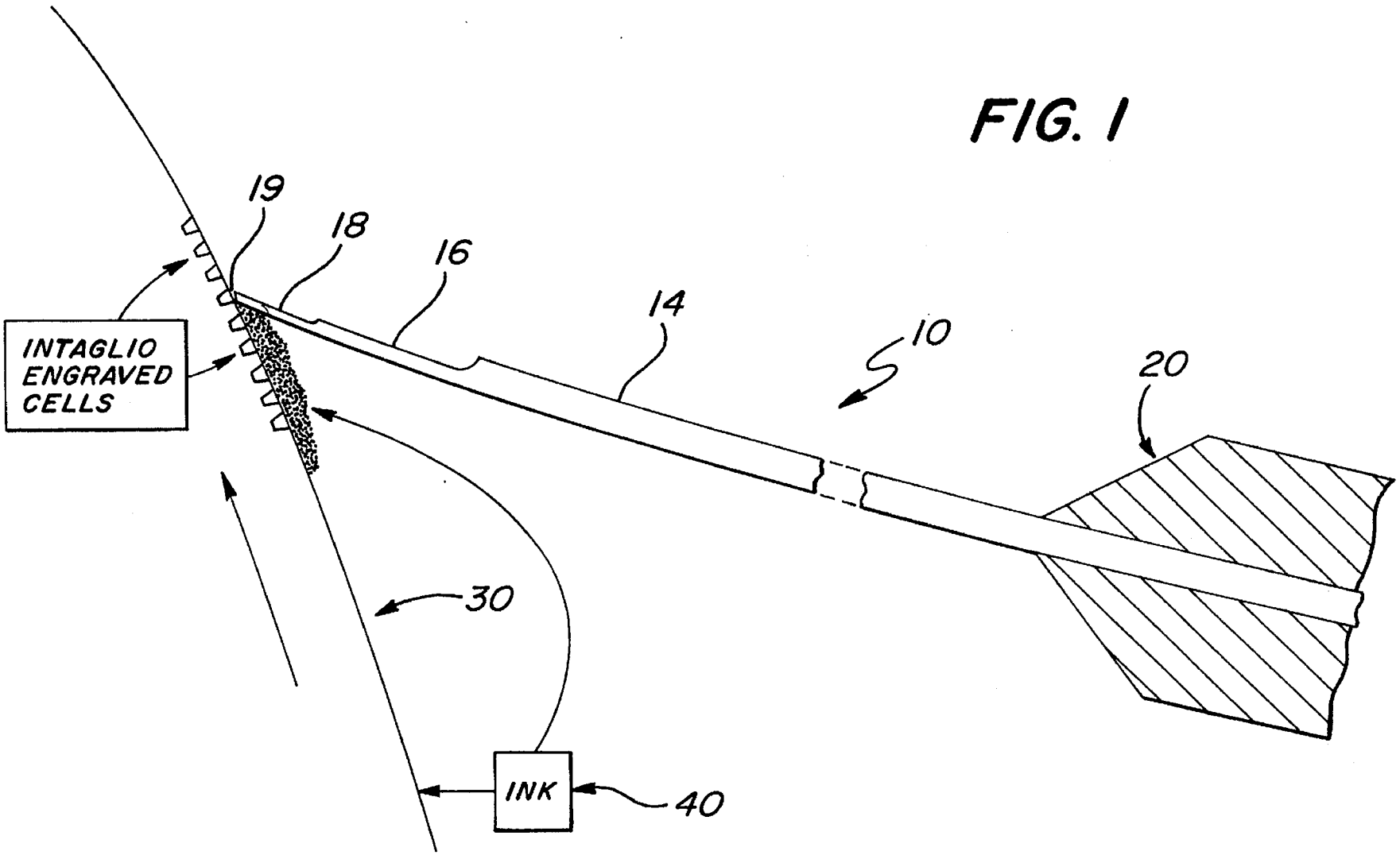
FIG. 1 is a schematic fragmentary view of a photogravure printing press equipped with a doctor blade designed according to the teachings of the present invention.

Referring now in greater detail to the figures of the drawings wherein like reference characters refer to like parts, the unitary doctor blade of the present invention is shown generally at 10 in FIG. 1.

Figure 2:
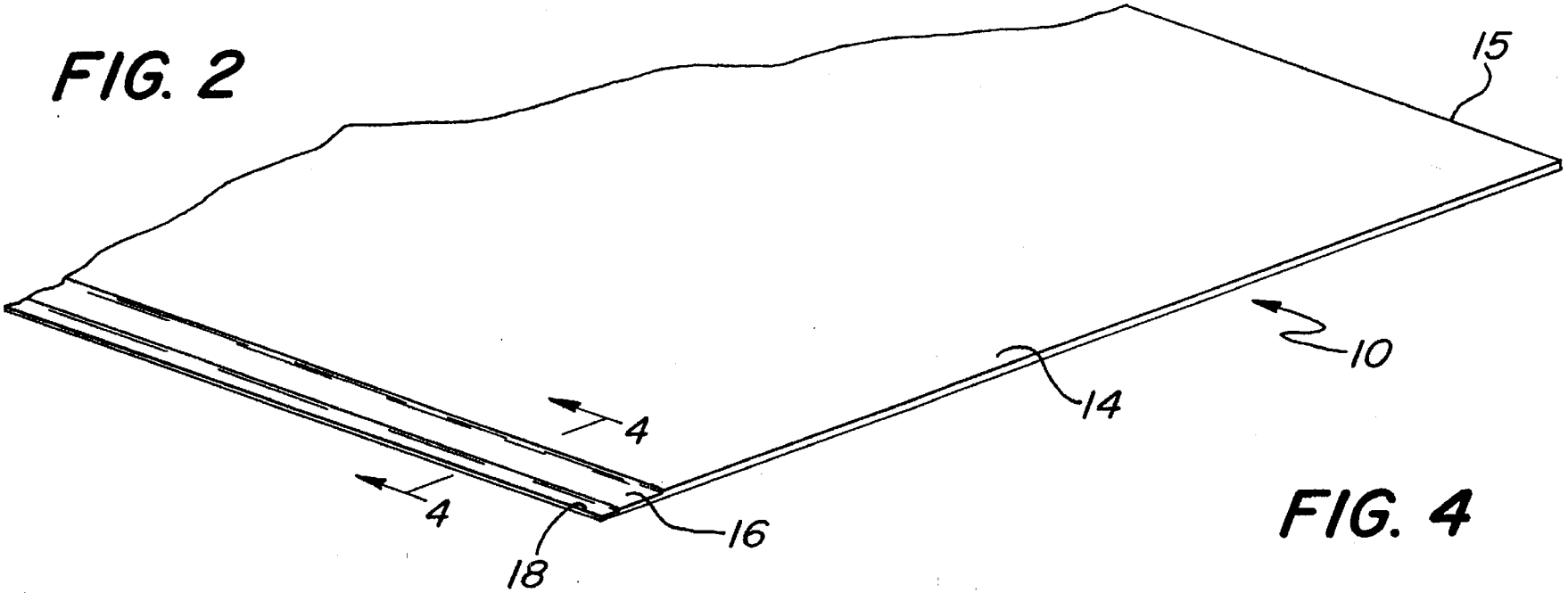
FIG. 2 is a fragmented perspective view of a doctor blade designed according to the teachings of the present invention.
Figure 4:
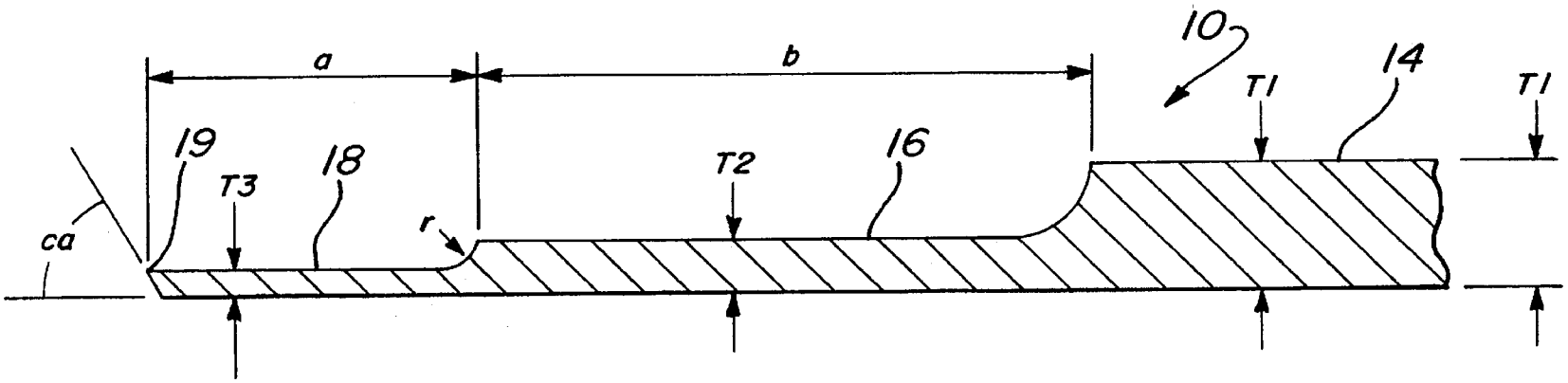
Figure 3:
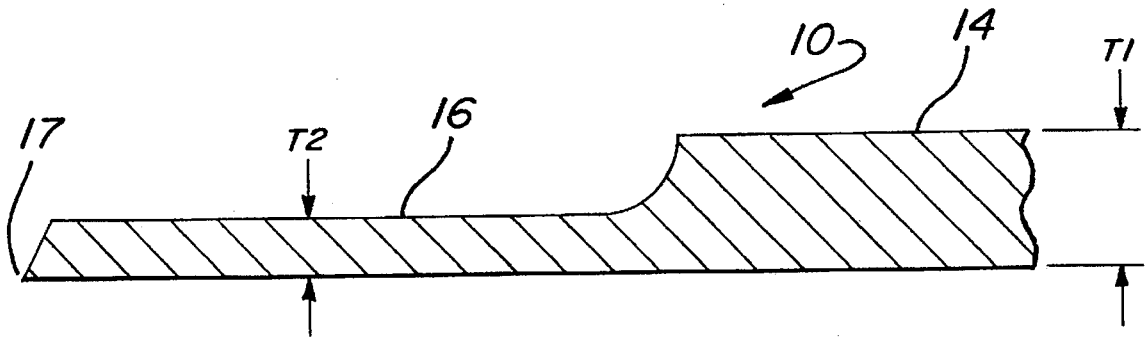
FIG. 3 is a fragmented sectional view of one embodiment of a doctor blade designed according to the teachings of the present invention; and, FIG. 4 is a fragmented sectional view of a doctor blade designed according to the teachings of the present invention taken along the line 4—4 of FIG. 2.

In the embodiment shown in FIGS. 1–3, the doctor blade 10 includes a backup portion 14, a doctor blade portion 16 having a thickness T2 less than the thickness T1 of the backup portion 14. As shown in FIG. 4, the doctor blade, further includes a blade tip portion 18 having a thickness T3 even less than the thickness of the doctor blade portion 16.

The backup portion 14 of the blade 10 extends from a rear edge 15 and is intended to be that portion of the blade that is inserted into a blade holder 20. The blade 10 is positioned in the blade holder 20 so that it urges against the outer circumference of a cylinder 30 (e.g., a gravure cylinder) to wipe excess ink therefrom. Ink is supplied to the circumference of the drum from an ink source 40 in the usual known manner. As the cylinder rotates, the blade 10 wipes the ink from the surface of the cylinder, leaving only the ink remaining below the surface in the cells.

In the preferred embodiment, the doctor blade 10 is prepared from a wide band roll of steel. It is recognized, however, that under some circumstances the blade may be suitably made from other materials such as plastics materials, for example, UHM polyethylene. So, while the invention is described in terms of using metal materials, other materials should be considered within the scope of the invention.

Steel band material typically is available in 200–250 mm widths. To obtain the necessary metal blank to prepare the doctor blade of the invention, the steel band is slit into desired width, usually ranging from 10 to 90 mm and the desired lengths. The width, thickness and length of each blade is determined by the size of the blade holder and the requirements of the press. Typically, the thickness of the steel is in the range to 0.250–0.400 mm. For this type of blade to have the necessary strength and rigidity for the desired dimensions, special high quality stainless steel or, preferably, carbon steel such as the type produced by Eberle GmbH (18 RR or 18 ER carbon steel) or the carbon steel produced by Uddeholm Corp. (UHB 20C carbon steel) is used.

In the preparation of the steel band material into the individual blades, individual widths of steel are slit from the lengths of the band roll of steel. During slitting, exacting care must be taken to insure that the slit edge that forms the forward edge 17, 19 of the blade 10 is as square with, or as perpendicular as possible to, the outer edges of the material. Excessive camber or convex bowing in the length of the edge will adversely wear against the circumference of the cylinder 30 and cause both the blade and the cylinder to wear unevenly due to the extra pressure exerted by the forward edge against the cylinder during the wiping process.

Once a blank for forming the blade is slit from the roll of steel and deburred, the blank is thereafter formed into the doctor blade 10 in the following manner. Taking as an example a blank having a thickness of 0.250 mm and a width of approximately 50 mm, the first step is to grind down one of the longitudinal edges of the blank, which thereafter becomes the front edge, to a depth of approximately 0.200 mm by removing approximately 0.050 mm of steel along the edge a distance of 5 mm. Thereafter, as a second step, an additional 0.050 mm of steel are removed to result in a doctor blade portion 16 having a thickness of approximately 0.150 mm.

There are several very important considerations involved in conducting the grinding process and in dimensioning the blade. The width of the total thickness of the steel blank that remains after the first two grinding operations results in the formation of the backup portion 14 of the blade 10 which will eventually fit into a blade holder 20. The two-step grinding of the edge to produce the doctor blade portion 16 is believed to be important because attempting to remove too much of the steel thickness at one time can harmfully change the physical characteristics of the metal, itself, as well as the actual dimensions of the metal. Even though the blade blank may have started out with no camber, if too much of the steel thickness is removed at one time, the resultant heat created not only can change the physical characteristics, it can actually induce camber into the blade. For these reasons, it is preferred to grind away at the thickness of the blank in multiple steps and preferably using multi-spindle grinding equipment with the necessary coolant flow, all the time keeping in mind that the goal is not to change the physical characteristics of the metal, nor to induce camber into the edge of the steel.

Following the first two grinding steps as shown in FIG. 3, the resultant blank then has a backup portion 14 with a width of approximately 45 mm and the remaining portion of the blank has the thickness of the doctor blade portion 16. At this stage, a blade configuration in unitary form is achieved that is acceptable for use in many wiping situations. Furthermore, as also shown in FIG. 3, the forward edge 17 of the doctor blade portion 16 can be beveled rearward to form a point, if desired, to enhance the wiping ability of the blade. It has been found, however, that such a doctor blade can be greatly improved by further reducing the thickness of the doctor blade portion to provide a blade tip of reduced thickness. Such a configuration is taught in U.S. Pat. No. 4,184,429, the teachings of which are incorporated herein by reference.

In order to achieve the advantages of the further reduced thickness blade portion at the front edge of the blade, additional material must be removed from the top surface of the doctor blade portion 16.

So, again in two grinding operations, an additional 0.075 mm of steel are removed (0.040 mm and 0.035 mm at a time) from the doctor blade portion 16 to produce the resultant blade tip portion 18 having a thickness T3 of approximately 0.075 mm, and a length of "a," and a top surface lower than the top surface of the doctor blade portion 16. The same considerations of heat generation and camber production are still present during these third and fourth grinding steps. A further consideration in the third and fourth steps is the width of the grind in each step. Because it is very important to have the correct radius "r" and length in the grind of the surface of the tip portion, the grinding steps increase slightly with each step to assure that the desired resultant width of the tip portion is achieved following the final grinding pass. In this instance, the width of the fourth grinding step was increased by 0.1 mm to a resultant tip portion 18 width of 1.4 mm, thereby leaving a doctor blade portion 16 having a width "b" of approximately 3.6 mm.

Having thus formed the blade, the blade undergoes a lapping process using lapping compound and a large cylinder to lap a contact angle "ca" at the outer forward edge 19 of the tip portion 18 (FIG. 4). In this instance the angle is created upward and outward from the bottom surface at a 60° angle; however, the angle can be varied depending on the requirements of the particular press.

As a result of the lapping process, a small burr is usually formed at the outer edge of the tip portion. Because this is the contact point with the cylinder, this burr is removed and a rounded tip edge is created. Thus, a good smooth wiping surface is created at the end of the blade to urge against the cylinder.

Use of the doctor blade of the present invention results in improved blade characteristics over the prior art multiple component, as well as laminated, doctor blades. First of all, because the blade in the preferred embodiment is machined from a single piece of high quality carbon steel, less total material is required to prepare the blade, since there is not the necessity of providing overlapping material just to achieve the laminate. Furthermore, in the prior art doctor blade arrangements, additional material is necessary to develop the required rigidity that is achieved with the single piece of carbon steel utilized in the present invention.

In addition, because a single piece of metal is used to form the blade, it is easier to control bending and flexing. With the thinner stock of the single sheet of carbon steel it is possible to control the dimensions of the material ground away to configure the blade in such a way as to get flexing in the areas where flexing is desired. Flexing of the blade of the present invention is controlled by selecting an appropriate blank thickness and varying the dimensions of the doctor blade portion 16 and the blade tip portion 18. This is done by varying the width and thickness of these portions as part of the grinding process. This ease and accuracy is not possible in the laminated blade structure. Certain printing and wiping applications require more or less flex in the blade, and the availability of the ability to easily create a blade from a single stock to obtain the correct flexibility is a great improvement.

Another important drawback of the prior art laminated blades that is eliminated is the worry of unwanted flexing later developing as a result of delamination that easily occurs when unnecessary pressure is applied to laminated blades after extended use. Once the lamination bond is lost, it is impossible to control flexing, which can ultimately lead to premature blade failure and damage to the gravure cylinder.

The doctor blade configuration of the present invention, although more expensive initially because of the use of the high quality carbon steel, instead of the lesser quality and costly laminate materials, is seen to be an improvement over the prior art laminated blades because of the increased rigidity, which controls flex and the resultant pressure required against the cylinder. Because it is possible to operate with less pressure against the cylinder, both the blade and the cylinder last longer, which is a substantial savings. Furthermore, the downtime to either change the blade or the cylinder is reduced greatly and down time costs money.

Finally, while the invention has been described in detail in relation to printing processes, the blade may be used in other situations where wiping is necessary, for example, the formation of thin films from the application of film material onto an appropriately formed cylinder, followed by wiping excess film material by means of a doctor blade (as is known in the art).

Without further elaboration, the foregoing will so fully illustrate our invention that others may, by applying future knowledge, adopt the same for use under various conditions of service.

We claim:

1. A doctor blade for wiping operations comprising a single piece of unitary material and having:

a top surface and a planar bottom surface spaced from said top surface;

a front longitudinal edge and a rear longitudinal edge spaced from and parallel to said front longitudinal edge;

a backup portion extending a first distance from said rear edge toward said front edge, said backup portion having a first thickness;

a doctor blade portion extending a second distance from said backup portion toward said front edge, said doctor blade portion having a second thickness less than said first thickness; and a blade tip portion extending along said planar bottom surface a third distance from said doctor blade portion to said front longitudinal edge, said blade tip portion having a third thickness less than said second thickness.

2. A doctor blade as claimed in claim 1, wherein said material is a rectangular blank of metal.

3. A doctor blade as claimed in claim 1, wherein said metal is carbon steel.

4. A doctor blade as claimed in claim 1, wherein said blade tip portion has an angled tip end at the front longitudinal edge thereof.

5. A doctor blade as claimed in claim 4, wherein said angled tip end is angled upward and forward from said planar bottom surface.

6. A doctor blade as claimed in claim 5, wherein said tip end is angled at a 60° angle upward from the plane of the bottom surface.

7. A doctor blade as claimed in claim 1, wherein said second distance is greater than said third distance.

8. A doctor blade as claimed in claim 1, wherein said first distance is greater than said third distance.

9. A doctor blade as claimed in claim 1, wherein said material is a rectangular blank of plastics material.

* * * * *